US006837572B2

(12) United States Patent
Ramaswami et al.

(10) Patent No.: US 6,837,572 B2
(45) Date of Patent: Jan. 4, 2005

(54) DROPLET PLATE ARCHITECTURE

(75) Inventors: Ravi Ramaswami, Vancouver, WA (US); Victor Joseph, Palo Alto, CA (US); Colin C. Davis, Corvallis, OR (US); Ronnie J. Yenchik, Blodgett, OR (US); Daniel A. Kearl, Philomath, OR (US); Martha A. Truninger, Corvallis, OR (US); Roberto A. Pugliese, Jr., Tangent, OR (US); Ronald L. Enck, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/643,264

(22) Filed: Aug. 19, 2003

(65) Prior Publication Data

US 2004/0032456 A1 Feb. 19, 2004

Related U.S. Application Data

(63) Continuation of application No. 10/244,351, filed on Sep. 16, 2002, now Pat. No. 6,682,874, which is a continuation of application No. 09/556,035, filed on Apr. 20, 2000, now Pat. No. 6,482,574.

(51) Int. Cl.[7] ..... B41J 2/16
(52) U.S. Cl. ..... 347/47; 216/27; 438/21
(58) Field of Search ..... 347/47, 65; 216/27; 430/320; 438/21

(56) References Cited

U.S. PATENT DOCUMENTS

| | | | |
|---|---|---|---|
| 3,852,563 | A | 12/1974 | Bohorguez et al. |
| 4,438,191 | A | 3/1984 | Cloutier |
| 4,491,606 | A | 1/1985 | Rosier et al. |
| 4,558,333 | A | 12/1985 | Sugitani et al. |
| 4,680,859 | A | 7/1987 | Johnson |
| 4,809,428 | A | 3/1989 | Aden |
| 4,847,630 | A | 7/1989 | Bhaskar |
| 4,851,371 | A | 7/1989 | Fisher |
| 4,862,197 | A | 8/1989 | Stoffel |
| 4,875,968 | A | 10/1989 | O'Neill |
| 4,894,664 | A | 1/1990 | Tsung Pan |
| 5,016,023 | A | 5/1991 | Chan |
| 5,041,190 | A | 8/1991 | Drake |
| 5,098,503 | A | 3/1992 | Drake |
| 5,160,577 | A | 11/1992 | Deshpande |
| 5,160,945 | A | 11/1992 | Drake |
| 5,194,877 | A | 3/1993 | Lam |
| 5,306,370 | A | 4/1994 | Herko et al. |
| 5,308,442 | A | 5/1994 | Taub |
| 5,317,346 | A | 5/1994 | Garcia |
| 5,442,384 | A | 8/1995 | Schantz |
| 5,478,606 | A | 12/1995 | Ohkuma et al. |
| 5,589,865 | A | 12/1996 | Beeson |
| 5,738,799 | A | 4/1998 | Hawkins et al. |

(List continued on next page.)

FOREIGN PATENT DOCUMENTS

| | | | |
|---|---|---|---|
| DE | 19536429 | A1 | 4/1997 |
| EP | 0244214 | A1 | 4/1987 |
| EP | 0 564 102 | A2 | 10/1993 |
| EP | 0783970 | A2 | 7/1997 |
| EP | 783970 | A2 | 7/1997 |
| JP | 5995156 | A | 10/1984 |
| JP | 0610098557 | | 5/1986 |
| JP | 62094347 | A | 4/1987 |
| JP | 0040052144 | | 2/1992 |

*Primary Examiner*—Lamson Nguyen
*Assistant Examiner*—Blaise Mouttet

(57) ABSTRACT

A process for fabricating a droplet plate for the printhead of an ink-jet printer, which process provides design flexibility, precise dimension control, as well as material robustness. Also provided is a droplet plate fabricated in accord with the process.

6 Claims, 3 Drawing Sheets

U.S. PATENT DOCUMENTS 5,851,412 A 12/1998 Kubby
5,980,017 A 11/1999 Sato
6,000,787 A 12/1999 Weber et al.
6,036,874 A 3/2000 Farnaam
6,099,106 A 8/2000 Werner
6,137,443 A 10/2000 Beatty
6,153,114 A 11/2000 Figuerdo
6,162,589 A 12/2000 Chen et al.
6,204,182 B1 3/2001 Truninger
6,303,274 B1 10/2001 Chen et al.
6,325,488 B1 12/2001 Beerling et al.
6,365,058 B1 4/2002 Beatty
6,482,574 B1 11/2002 Ramaswami et al.
6,485,132 B1 11/2002 Hiroki et al.
2003/0082841 A1 5/2003 Haluzak et al.

DROPLET PLATE ARCHITECTURE

This is a continuation of U.S. application Ser. No. 10/244,351 file date Sep. 16, 2000 now U.S. Pat. No. 6,682,874, which was a continuation of U.S. application Ser. No. 09/556,035 file date Apr. 20, 2000, now U.S. Pat. No. 6,482,574.

TECHNICAL FIELD

This invention relates to the construction of a droplet plate.

BACKGROUND

An ink-jet printer includes one or more cartridges that contain a reservoir of ink. The reservoir is connected by a conduit to a printhead that is mounted to the body of the cartridge.

The printhead is controlled for ejecting minute droplets of ink from the printhead to a printing medium, such as paper, that is advanced through the printer. The ejection of the droplets is controlled so that the droplets form images on the paper.

In a typical printhead, the ink droplets are expelled through orifices that are formed in an orifice plate that covers most of the printhead. The orifice plate is usually electroformed with nickel and coated with a precious metal for corrosion resistance. Alternatively, the orifice plate is made from a laser-ablated polyimide material.

The orifice plate is bonded to an ink barrier layer of the printhead. This barrier layer is made from photosensitive material that is laminated onto the printhead substrate, exposed, developed, and cured in a configuration that defines ink chambers. The chambers have one or more channels that connect the chambers with the reservoir of ink. Each chamber is continuous with one of the orifices from which the ink droplets are expelled.

The ink droplets are expelled from each ink chamber by a heat transducer, such as a thin-film resistor. The resistor is carried on the printhead substrate, which is preferably a conventional silicon wafer upon which has been grown an insulation layer, such as silicon dioxide. The resistor is covered with suitable passivation and other layers, as is known in the art and is described, for example, in U.S. Pat. No. 4,719,477, hereby incorporated by reference.

To expel an ink droplet, the resistor is driven (heated) with a pulse of electrical current. The heat from the resistor is sufficient to form a vapor bubble in the surrounding ink chamber. The rapid expansion of the bubble instantaneously forces a droplet through the associated orifice. The chamber is refilled after each droplet ejection with ink that flows into the chamber through the channel(s) that connects with the ink reservoir.

In the past, the orifice plate and barrier layer were mechanically aligned and bonded together, usually in a high-temperature and high-pressure environment. Inasmuch as the orifice plate and barrier layers are made of different material, the need for precisely aligning these two components is complicated by the differences in their coefficients of thermal expansion. Also, this approach to constructing a printhead limits the minimum thickness of the bonded components to about 25 $\mu$m, which thus prevents the use of very small droplet volumes with the attendant high resolution and thermal efficiencies such use would permit.

Currently, the notion of an integrally formed orifice plate and barrier layer has been considered. For clarity, an integrated orifice plate and barrier layer will be hereafter referred to as a droplet plate, which is a unitary plate defining both the ink chambers and orifices (the orifices hereafter referred to as nozzles). It will be appreciated that such a plate eliminates the problems associated with the orifice plate and barrier layer construction just mentioned.

Manufacture of such a droplet plate may be carried out using photolithographic techniques, which techniques generally offer a high degree of design latitude. It is desirable, however, to arrive at a simple, reliable fabrication process that has very precise dimension control as well as one that results in materials that are robust and inert.

SUMMARY OF THE INVENTION

The present invention concerns a process for fabricating a droplet plate and provides design flexibility, precise dimension control, as well as material robustness. Also provided is a droplet plate fabricated in accord with the process.

Other advantages and features of the present invention will become clear upon study of the following portion of this specification and the drawings.

DETAILED DESCRIPTION OF PREFERRED EMBODIMENTS

The process generally comprises a two-stage deposition and patterning/etching procedure whereby the firing chambers in the droplet plate are formed first, followed by the nozzles. The process does not rely on etch selectivity between materials. As a result, a good deal of design flexibility is provided in selecting the droplet plate material. In this regard, robust, highly inert materials can be used as the droplet plate to provide effective resistance to chemical attack, such as from the ink.

The deposition aspect of the process is preferably carried out using plasma-enhanced chemical vapor deposition (PECVD), which, among other things, permits the use of the highly inert materials (such as silicon oxide) as compared to, for instance, spin-on polymers and epoxies. Sputter deposition, also known as physical vapor deposition (PVD), may also be employed for depositing the dielectric material.

Although an integrated droplet plate (comprising both firing chambers and associated nozzles) is fabricated by the process of the present invention, the process steps are such that the firing chambers and nozzles may be shaped independently of one another.

In a preferred embodiment, the droplet plate is formed directly on the printhead substrate, which substrate carries the heat transducers as mentioned above. A dielectric material layer is deposited via PECVD onto the substrate and shaped to form firing chambers. In one approach, this shaping is carried out by depositing the layer to a depth matching that of the firing chamber and then employing reactive-ion-etching to define the chamber volume.

The chamber volume is then filled with sacrificial material, which is planarized before an additional amount of dielectric material is deposited to a depth desired as the thickness of the nozzle. The nozzle volume is then etched and the sacrificial material removed to complete the droplet plate fabrication.

In another embodiment, a single deposit of dielectric material is made over previously placed bumps of sacrificial material. The bumps are sized to match the volume of the firing chambers and are placed over each heat transducer. The layer is then etched to define the nozzles, and the sacrificial material is then removed, yielding a droplet plate that is produced with a single PECVD step.

Figure 1:
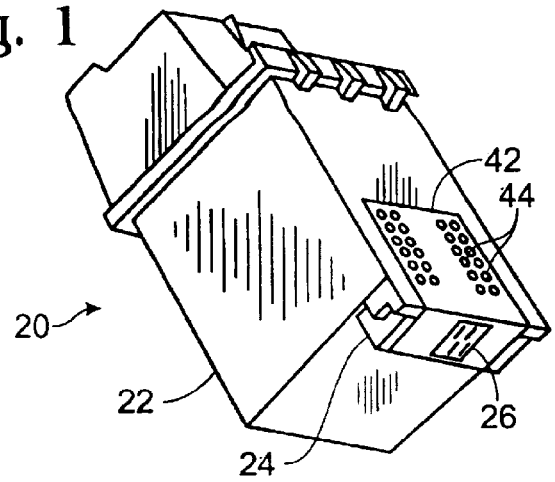
FIG. 1 is a perspective view of an ink-jet cartridge that carries a printhead having a droplet plate formed in accordance with one preferred approach to the present invention.

With reference to FIG. 1, a printhead 26 having a droplet plate formed in accordance with the preferred embodiment of the present invention may be carried on an ink-jet cartridge 20. The cartridge 20 includes a plastic body 22 that comprises a liquid ink reservoir. As such, the cartridge 20 includes both the ink supply and printhead. It will be clear upon reading this description, however, that a printhead having a droplet plate according to the present invention may be used with any of a variety of cartridge configurations, including for example, cartridges having very small reservoirs that are connected to larger-volume remote ink supplies.

The illustrated pen body 22 is shaped to have a downwardly extending snout 24. The printhead 26 is attached to the underside of the snout 24. The printhead 26 is formed with minute nozzles from which are ejected ink droplets onto the printing medium.

Figure 8:
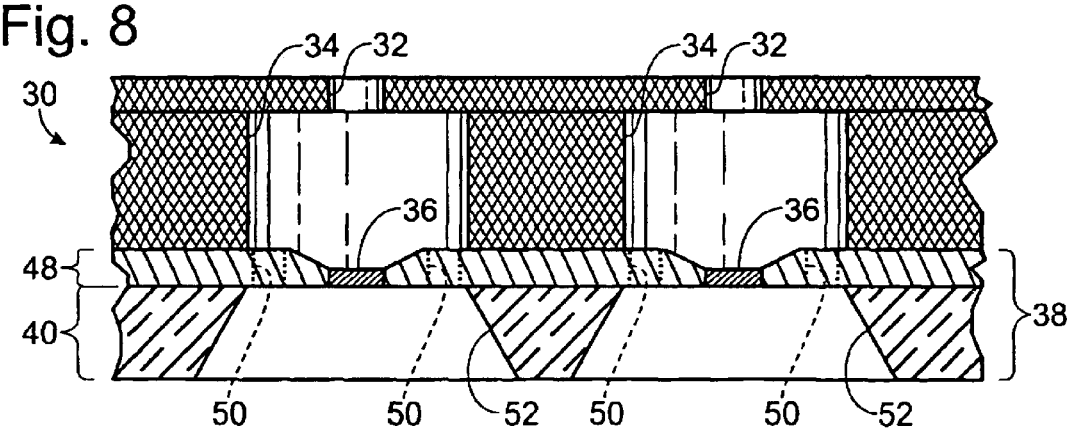
Figure 9:
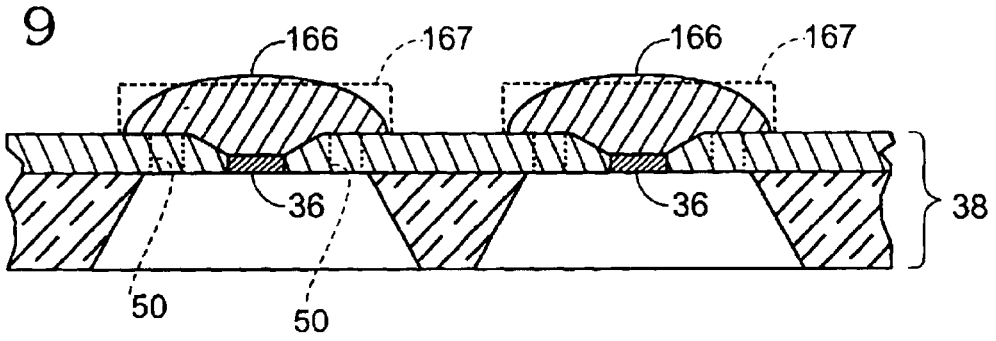
FIGS. 9–12 are diagrams showing preferred steps undertaken in making a droplet plate in accord with another approach to the present invention.

Referring next to FIG. 8, which is an enlarged cross sectional view of a droplet plate 30 after its final fabrication step, each printhead nozzle 32 is integrally formed with the droplet plate 30 and opens to a firing chamber 34 in the droplet plate. The small volume of ink in the firing chamber 34 is fired through the associated nozzle 32 toward print media.

As mentioned earlier, the droplet firing is caused by the rapid vaporization of some of the ink in the chamber by a heat transducer, such as a thin-film resistive layer. The resistor is part of the printhead substrate 38, described more below. In the present invention, the droplet plate 30 is formed directly on the substrate 38, thereby eliminating the need for separately bonding together those two parts. FIG. 8 depicts only a piece of the droplet plate 30 that includes two nozzles 32, although a typical droplet plate 30 will have several nozzles.

Figure 2:
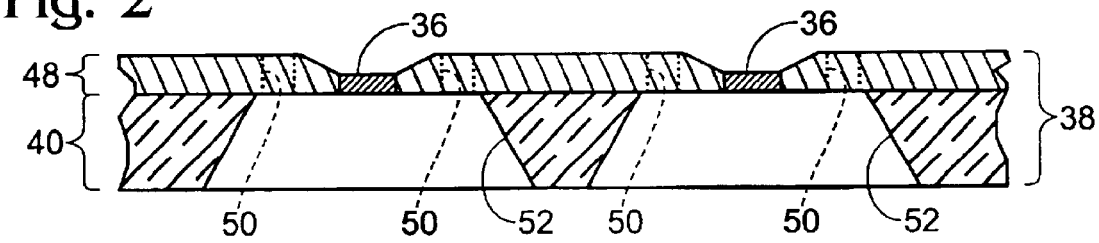
FIG. 2 is an enlarged sectional diagram of a printhead substrate onto which the droplet plate of the present invention is formed.

The description of the process for making the droplet plate of the present invention is begun with particular reference to FIG. 2, which shows the printhead substrate 38 before fabrication of the droplet plate 30. The substrate 38 includes a silicon base 40, which is preferably a conventional silicon wafer upon which has been grown an insulation layer, such as silicon dioxide.

As described in the prior art, such as U.S. Pat. No. 4,719,477, a layer of resistive material, such as tantalum aluminum, includes portions that are individually connected by conductive layers to traces on a flex circuit 42 (FIG. 1) that is mounted to the exterior of the cartridge body 22. Those traces terminate in exposed contacts 44 that mate with like contacts on a printer carriage (not shown), which in turn is connected, as by a ribbon-type multi conductor, to the printhead drive circuitry and microprocessor of the printer. The printer microprocessor controls the current pulses for firing individual resistors as needed.

The heat transducer portions of the resistive layer are part of what may be collectively referred to as the control layer 48 (and shown as a single layer in the figures) of the substrate 38, which includes passivation and other sublayers as described, for example, in U.S. Pat. No. 4,719,477. The hatched portions 36 in the control layer 48 illustrate the location of the heat transducers. The heat transducers 36 are connected with the conductive layers and traces as mentioned above.

Ink feed holes 50 are formed through the control layer 48 on the substrate, spaced from conductive and resistive portions of the control layer. The feed holes 50 provide fluid communication between the firing chambers 34 (FIG. 8) and associated conduits 52 that are etched into the underside of the substrate 38. These conduits 52 are connected to ink reservoir(s) so that the chambers 34 can be refilled after each droplet is fired. Although the conduits 52 and feed holes 50 appear in FIG. 2, it is noted that these components may be formed in the printhead substrate after the droplet plate fabrication is complete.

Figure 3:
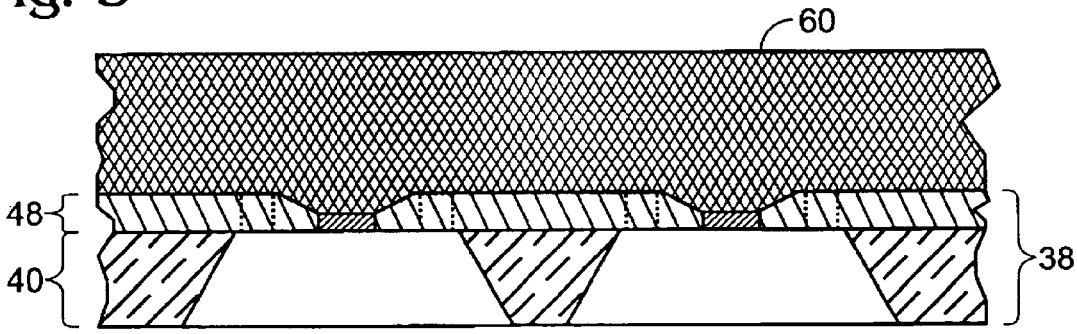
FIGS. 3–8 are diagrams showing preferred steps undertaken in making a droplet plate in accord with one approach to the present invention.

FIG. 3 shows a first step in the fabrication of a droplet plate directly upon the substrate 38. A first layer 60 of dielectric material is deposited onto the substrate 38. The dielectric material 60 is selected to be robust, highly inert, and resistive to chemical attack. Acceptable materials include silicon dioxide, silicon nitride, silicon carbide or combinations of these three. Other materials include amorphous silicon, silicon oxynitride, and diamondlike carbon (DLC). The deposition is carried out by conventional plasma-enhanced chemical vapor deposition (PECVD) or high-density plasma PECVD (HDP-PCVD). Alternatively, high-rate sputter deposition may be utilized. In any event, it will be appreciated that the process of the present invention advantageously uses deposition (and etching) techniques well understood by those of ordinary skill in the art. Process parameters, such as power, pressure, gas flow rates and temperature, can be readily established for a selected dielectric material.

Preferably, the first layer 60 of dielectric material is deposited to thickness of 5–20 $\mu$m, which matches the thickness (or height) of the firing chamber 34 as measured vertically in FIG. 8 from the top of the substrate 38.

Figure 4:
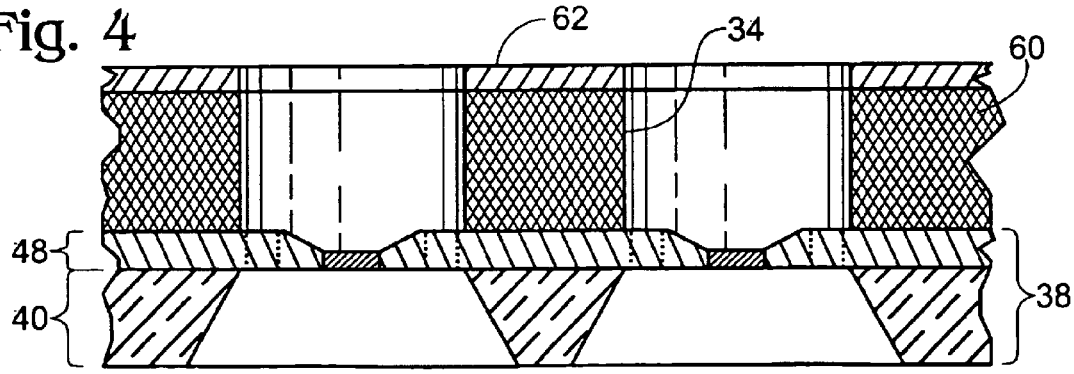

After the deposition of the first layer 60, conventional photoimagable material 62 is applied to the first dielectric layer 60 and patterned to define the shape (considered in plan view) of the firing chambers 34 (FIG. 4). The photoimagable material may be any soft or hard mask such as photoresist, epoxy polyamideacrylate, photoimagable polyimide, or other appropriate photoimagable material. Hard mask material might include a dielectric or metal material that could be imaged using the above-mentioned soft masking material.

It will be appreciated that, in addition to the firing chambers shapes, the foregoing step could be employed to define lateral ink feed channels that extend across the substrate to conduct ink to each chamber from a feed slot that is remote from the chamber. This ink channel configuration would be employed as an alternative to the feed holes 50 described above. Exemplary ink feed channels are depicted in U.S. Pat. No. 5,441,593, hereby incorporated by reference. The ink feed channels are processed (filled with sacrificial material, planarized and covered with a second deposition of dielectric material) coincident with the subsequent processing steps of the chambers 34, as described next.

FIG. 4 shows the cavities that will become the firing chambers 34 of the droplet plate.

These cavities are present after the development of the patterned photoimagable material 62 (here, assuming positive resist) and etching of the dielectric layer 60. The etching step employs plasma etching or dry etching such as reactive-ion-etching (RIE). Here again, the selection of the etching process parameters would be well known to one of ordinary skill in the art.

It is noteworthy here that the firing chambers 34 are shown in the figures as identically sized and generally cylindrical in shape. It will be appreciated, however, that other shapes may be employed. Moreover, the sizes of some chambers relative to others may be different. This may be desirable where, for example, a printhead capable of firing multiple colors of inks or multiple ink-droplet sizes is employed. For example, in some applications it may be desirable to have the firing chambers that are dedicated to black ink to be twice as large as the chambers that are dedicated to colored ink. The process described here takes advantage of the design flexibility inherent in the use of the photoimagable material for defining the shape of the ink chambers, and thus permits, for example, the differential firing chamber sizing just mentioned.

After the cavities for the firing chambers 34 are defined in the first layer of dielectric material 60, the material is readied for the deposition of more of the same or similar type of dielectric material for spanning the top of the chamber 34. This second layer may be, for example, silicon dioxide, silicon nitride, silicon carbide, or combinations of these three. Other materials include amorphous silicon, silicon oxynitride, and diamondlike carbon (DLC).

Figure 5:
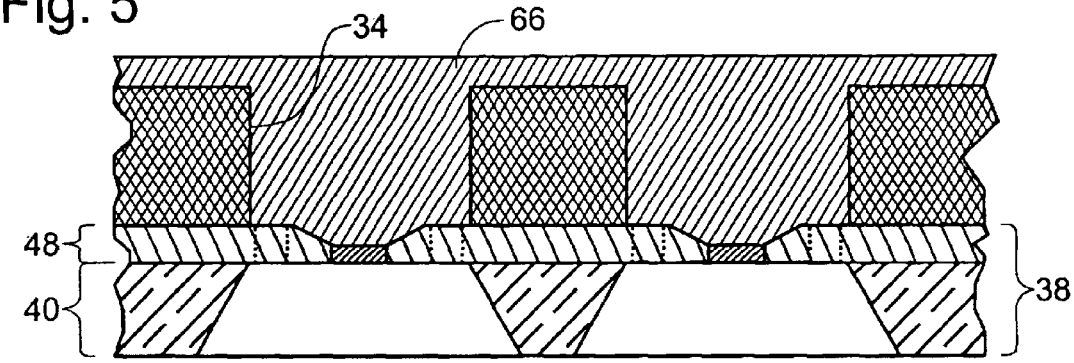

Before the deposition of the second layer of dielectric material, the first layer is processed so that the firing chambers 34 are filled with sacrificial material 66 as shown in FIG. 5. This sacrificial material 66 may be photoresist or spin-on-glass (SOG), or any other material that can be selectively removed.

Figure 6:
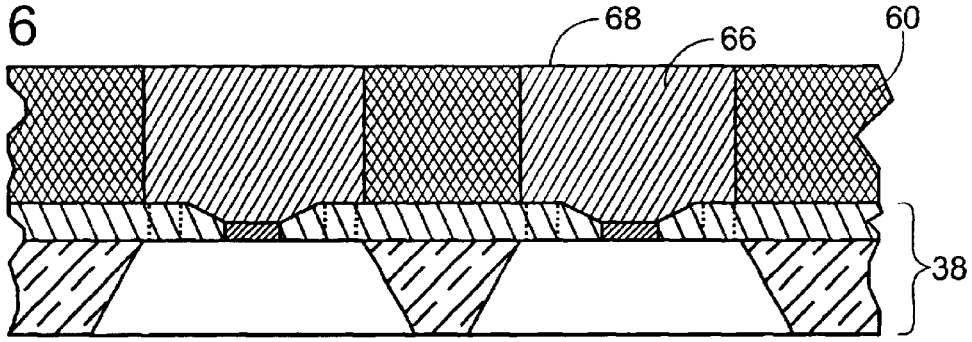

If SOG is used as the sacrificial material 66, that material is then planarized after curing so that its upper surface 68 matches the upper level of the first-deposited layer 60 of the dielectric material 60, as shown in FIG. 6. Conventional chemical mechanical polishing (CMP) can be used to achieve this planarization.

In the event that a photoresist or other selectively removable material is used as the sacrificial material 66, a resist etch back (REB) process can be used to planarize the sacrificial material to limit its extent to inside the cavities of the firing chambers 34 (and to the same height 68 as the firing chambers). Alternatively, a photoresist sacrificial material could be UV exposed and developed first in a manner such that the photoresist remains only in the cavities of the chambers 34. Afterward, that material could be made planar with the firing chamber by using either a CMP or REB process.

In the event that a photoresist is used as the sacrificial material, a hard bake step may be carried out before the second deposition of dielectric material, described next.

Figure 7:
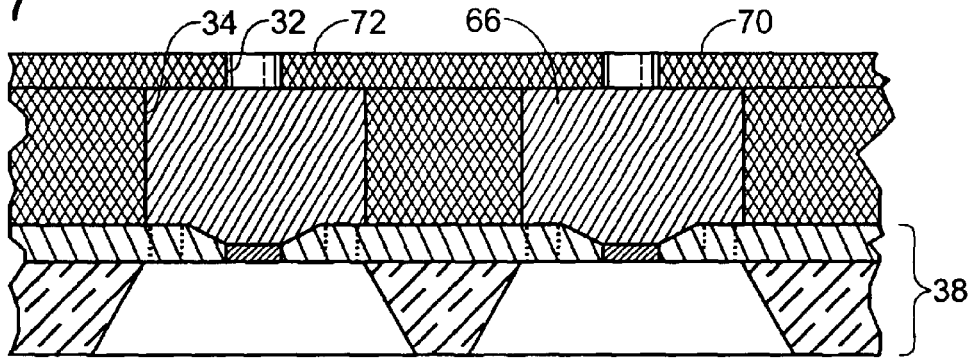

Once the sacrificial material 66 is planarized as described above, the second deposition of dielectric material 70 is made, preferably using the same or similar type of material (silicon dioxide, etc.) as is used in depositing the first layer 60. As shown in FIG. 7, this layer spans across the chambers 34 and is deposited at a thickness (for example, 5–15 $\mu$m) that matches the desired length (measured vertically in FIG. 7) of the nozzle 32.

FIG. 7 shows the second layer 70 of dielectric material after deposition and after nozzles 32 are formed through that layer to place the nozzles in communication with the underlying chambers 34 (the sacrificial material is later removed as explained below). The process step for forming of nozzles 32 in this embodiment is substantially similar to the process for defining the firing chambers. Specifically, conventional photoimagable material (not shown) is applied to the upper surface 72 of the second dielectric layer 70 and patterned to define the shape (considered in plan view) of the nozzles 32.

The patterned photoimagable material is developed (here, again, assuming positive resist, although negative resist can be used) and the second dielectric layer 70 is etched using plasma etching or dry etching.

It will be appreciated that the shapes of the nozzles 32 can be defined quite independently of the shapes of the firing chambers 34. Also, as was the case with the firing chambers, the diameter of some nozzles 32 may be different relative to other nozzles. This may be desirable where, for example, a printhead capable of firing multiple colors of inks is employed. Moreover, the precision and resolution inherent in the use of the photoimagable material for defining the shape of the nozzles permits formation of extremely small nozzles (as well as firing chambers) to obtain high-resolution printing and the thermal efficiencies that are available when heating relatively smaller volumes of ink.

As another advantage to having nozzle configurations formed independently of the chambers, it is contemplated that an asymmetrical nozzle/chamber relationship is possible (which may improve the overall hydraulic performance of the printhead). In the past, nozzles were most often formed to be centered over the chambers.

After the nozzles 32 are formed, the sacrificial material is removed. To this end, a plasma oxygen dry etch or a wet acid etch or solvent may be employed. The resulting droplet plate 30 (that is, with sacrificial material 66 removed) is depicted in FIG. 8.

FIGS. 9–12 are diagrams showing preferred steps undertaken in making a droplet plate 130 in accord with another approach to the present invention. This embodiment of the invention provides a droplet plate that can be formed on a substrate 38, as was the earlier described embodiment of the droplet plate 30. Consequently, a description of the particulars of the printhead substrate 38 will not be repeated here.

Figure 10:
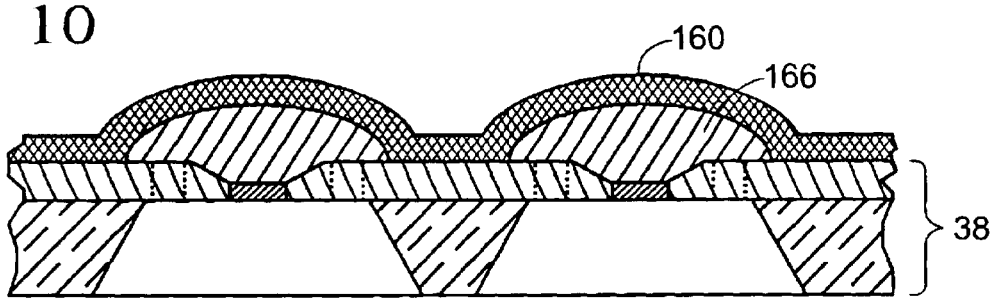
Figure 11:
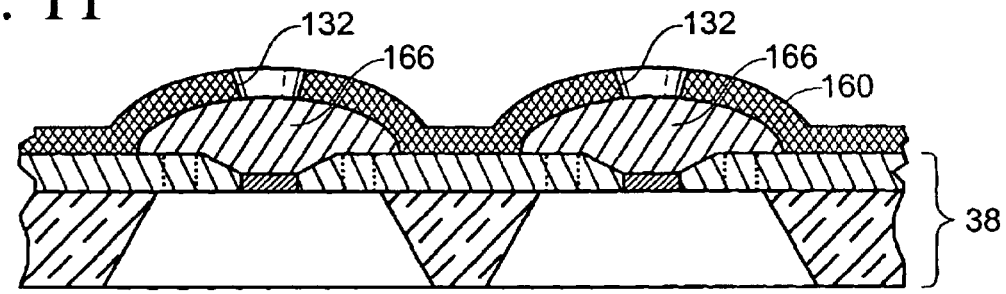
Figure 12:
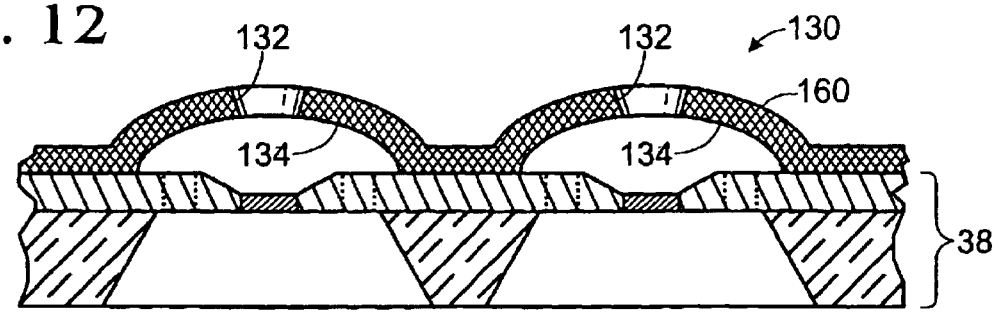

In the process illustrated in FIGS. 9–12, each heat transducer 36 and adjacent feed hole 50 are covered (FIG. 9) with a bump of sacrificial material 166 that is sized to correspond to the interior of the firing chamber 134 (FIG. 12). The bumps 166 may be provided by the application of a spin-on photoresist material that is later exposed and developed to remove the material between the resistors.

The initial configuration of the bumps, at this stage, will be generally cylindrical. As shown at dashed lines 167 in FIG. 9. In order to make the bumps 166 stable and able to withstand the high temperatures required in the later steps of this process, the bumps are baked for at least one minute at a temperate of about 200° C. As a consequence of the baking, the bumps 166 flow somewhat to take on the rounded shape depicted in FIG. 9. It will be appreciated, therefore, that one can select the amount of sacrificial bump material, as well as its thermal deformation characteristics such that a preferred firing chamber shape (somewhere between the original cylindrical shape and a uniform-radius curved shape) may be produced upon baking the bump material.

Deposition of high quality dielectrics at low temperatures is possible using high density plasma PCVD (HDP-PECVD)

with wafer backside cooling. If HDP-PECVD is used in the following step to deposit the layer of dielectric material 160, it will be appreciated that the lower temperatures associated with the deposition step will permit a correspondingly lower temperature (for example 140° C.) for baking the bump material, assuming acceptable bump sidewall configurations can be achieved at such a temperature.

As shown in FIG. 10, a single layer of dielectric material 160 is next deposited onto the substrate 38 to cover the bumps 166. The dielectric material 160 is deposited using a PECVD or sputter deposition process, and the material selected is robust, highly inert, and resistive to chemical attack as was the dielectric material 60 described above. This layer 160 is deposited onto the substrate 38 over the bumps as well as in the regions between the individual bumps 166, thereby to physically separate one bump (hence, one firing chamber 134 and associated feed holes) from another.

This single-deposit layer 160 of dielectric material, in covering each bump, thus simultaneously provides the walls of the firing chambers 134 as well as the overall thickness of what, in prior art embodiments, would have been referred to as the orifice plate.

The nozzles 132 are then plasma or dry etched through this layer 160 (FIG. 11) and the sacrificial material 166 is removed as respectively described in connection with the steps of forming of the nozzles 32 and removing sacrificial material 66 in the earlier embodiment. As before, the shape of the nozzle 132 is formed independently of the shape of the firing chamber 134. It will be appreciated that, prior to removal of sacrificial material, the process step depicted in FIG. 11 is analogous to the step illustrated in FIG. 7 in that that there is a layer of dielectric material forming droplet plate firing chamber that is filled with sacrificial material.

While the present invention has been described in terms of preferred embodiments, it will be appreciated by one of ordinary skill that the spirit and scope of the invention is not limited to those embodiments, but extend to the various modifications and equivalents as defined in the appended claims.

Thus, having here described preferred embodiments of the present invention, the spirit and scope of the invention is not limited to those embodiments, but extend to the various modifications and equivalents of the invention defined in the appended claims.

What is claimed is:

1. A method of making a part of a droplet plate, which part mounts to a substrate that carries a beat transducer and defines both a firing chamber to surround the transducer and a nozzle through which liquid in the chamber may pass from the chamber; the method comprising the steps of:

forming the part from a single type of dielectric material by depositing first layer of the dielectric material using plasma-enhanced chemical vapor deposition;

shaping the firing chamber in the first layer;

depositing a second layer of the single type of dielectric material; and making the nozzle in the second layer.

2. A method of making a part of a droplet plate, which part mounts to a substrate that carries a heat transducer and defines both a firing chamber to surround the transducer and a nozzle through which liquid in the chamber may pass from the chamber; the method comprising the steps of:

forming the part from a single type of dielectric material by depositing a first layer of the dielectric material;

shaping the firing chamber in the first layer;

depositing a second layer of the single type of dielectric material;

wherein the first layer and second layer of dielectric material are selected from the group consisting of silicon dioxide, silicon nitride, silicon carbide, amorphous silicon, silicon oxynitride and diamondlike carbon; and making the nozzle in the second layer.

3. The method of claim 2 wherein the first layer of dielectric material and the second layer of dielectric material is selected to be the same material.

4. A method of making a part of a droplet plate, which part mounts to a substrate that carries a heat transducer and defines both a firing chamber to surround the transducer and a nozzle through which liquid in the chamber may pass from the chamber; the method comprising the steps of:

forming the part from, a first dielectric material by depositing a first layer of the dielectric material, wherein the first dielectric material comprises silicon dioxide;

shaping the firing chamber in the first layer; then depositing a second layer of the first dielectric material; and making the nozzle in the second layer.

5. The method of claim 4 including the step of simultaneously exposing the first and second layers to one of an etchant or solvent.

6. A method of making a part of a droplet plate, which part mounts to a substrate that carries a heat transducer and defines both a firing chamber to surround the transducer and a nozzle through which liquid in the chamber ay pass from the chamber, the method comprising the steps of:

forming the part from a first dielectric material by depositing a first layer of the dielectric material, wherein the first layer of dielectric material is selected from the group consisting of silicon dioxide, silicon nitride, silicon carbide, amorphous silicon, silicon oxynitride and diamondlike carbon;

shaping the firing chamber in the first layer; then depositing a second layer of the first dielectric material; and making the nozzle in the second layer.

* * * * *

UNITED STATES PATENT AND TRADEMARK OFFICE

CERTIFICATE OF CORRECTION

PATENT NO. : 6,837,572 B2
DATED : January 4, 2005
INVENTOR(S) : Ramaswami et al.

It is certified that error appears in the above-identified patent and that said Letters Patent is hereby corrected as shown below:

Column 7,
Line 49, delete “beat” and insert in lieu thereof -- heat --;
Line 54, after “depositing” insert -- a --;

Column 8,
Line 43, delete “ay” and insert in lieu thereof -- may --.

Signed and Sealed this

Fifteenth Day of March, 2005

JON W. DUDAS
*Director of the United States Patent and Trademark Office*